US007025893B2

(12) United States Patent
Goodsel et al.

(10) Patent No.: US 7,025,893 B2
(45) Date of Patent: Apr. 11, 2006

(54) STRUCTURE AND METHOD TO COMPENSATE FOR THERMAL EDGE LOSS IN THIN FILM HEATERS

(75) Inventors: Arthur J. Goodsel, St. Clair, MI (US); Scott A. Cooper, Salinas, CA (US); Kerry A. Goodsel, Pacific Grove, CA (US)

(73) Assignee: Thermo Stone USA, LLC, Marina, CA (US)

( * ) Notice: Subject to any disclaimer, the term of this patent is extended or adjusted under 35 U.S.C. 154(b) by 34 days.

(21) Appl. No.: 10/639,813

(22) Filed: Aug. 12, 2003

(65) Prior Publication Data

US 2005/0035111 A1 Feb. 17, 2005

(51) Int. Cl.
*H01B 13/00* (2006.01)
*H05B 3/16* (2006.01)

(52) U.S. Cl. ..... 216/13; 216/16; 216/101; 219/543

(58) Field of Classification Search ..... 216/16, 216/17, 13; 219/543, 539, 540, 541, 542, 219/544, 546, 547, 548, 552, 465.1, 466.1, 219/462.1; 392/407, 432, 433, 434, 435, 392/438, 439

See application file for complete search history.

(56) References Cited

U.S. PATENT DOCUMENTS

| | | | | |
|---|---|---|---|---|
| 3,601,745 | A | | 8/1971 | Helgeland |
| 3,722,085 | A | | 3/1973 | Caddock |
| 4,002,883 | A | | 1/1977 | Hurko |
| 4,301,439 | A | | 11/1981 | Johnson et al. |
| 4,604,298 | A | * | 8/1986 | Shevtchuk et al. ..... 427/98.4 |
| 4,769,527 | A | | 9/1988 | Hart et al. |
| 4,808,798 | A | | 2/1989 | Goessler et al. |
| 4,833,300 | A | | 5/1989 | Bard et al. |
| 4,843,218 | A | | 6/1989 | Husslein et al. |
| 4,888,467 | A | | 12/1989 | Hoffmann |
| 4,931,627 | A | * | 6/1990 | Watts ..... 219/548 |
| 4,970,376 | A | | 11/1990 | Mellor et al. |
| 5,019,691 | A | | 5/1991 | Lai |
| 5,105,066 | A | | 4/1992 | Houdy et al. |
| 5,294,778 | A | | 3/1994 | Carman et al. |
| 5,317,132 | A | | 5/1994 | Clough et al. |
| 5,352,864 | A | | 10/1994 | Schultheis et al. |
| 5,616,266 | A | | 4/1997 | Cooper |
| 5,700,992 | A | | 12/1997 | Honda et al. |
| 5,889,261 | A | | 3/1999 | Boardman |
| 5,973,298 | A | | 10/1999 | Källgren |
| 6,194,692 | B1 | * | 2/2001 | Oberle ..... 219/543 |
| 6,242,722 | B1 | | 6/2001 | Provancha et al. |
| 6,314,216 | B1 | | 11/2001 | Schulte et al. |
| 6,376,816 | B1 | | 4/2002 | Cooper et al. |
| 2003/0001719 | A1 | | 1/2003 | Schemenaur et al. |

* cited by examiner

*Primary Examiner*—Parviz Hassanzadeh
*Assistant Examiner*—Roberts Culbert
(74) *Attorney, Agent, or Firm*—Dorsey & Whitney LLP

(57) ABSTRACT

A thin film heater includes at least two open regions formed along each of two spaced-apart edges of the thin film material, which edges are parallel to two spaced-apart edges of the underlying substrate. The open regions expose areas of underlying substrate. When electrical power is coupled to the two spaced-apart edges of the thin film material, uniformity of the heat generated across the thin film material is enhanced. The substrate may be planar or curved, and the open regions in the thin film material may be removed from deposited thin film material, or may be formed by preventing deposition of thin film material in such regions.

20 Claims, 10 Drawing Sheets

STRUCTURE AND METHOD TO COMPENSATE FOR THERMAL EDGE LOSS IN THIN FILM HEATERS

FIELD OF THE INVENTION

The present invention relates generally to thin film heaters, and more particularly to providing thermal heaters with improved thermal uniformity by compensating for thermal edge loss and effects of heat sinks.

BACKGROUND OF THE INVENTION

Thin film heaters typically comprise a growth or deposition of a thin film of electrically conductive resistive material on an electrically insulating support substrate, e.g., glass, quartz, glass ceramic, alumina, etc. Alternatively, the thin film material can be deposited upon a substrate that is electrically conductive, e.g., stainless steel, if the deposition surface of the substrate is first treated with a dielectric coating, e.g., DuPont™ material part number 3500, or Electro Science Laboratories material, part number 4914. Other dielectric coating materials may be used, if desired.

In a thin film heater, when a source of voltage is coupled across the thin film resistive material, the resultant electrical current causes the thin film to generate heat. However, heat is not generated uniformly across the surface of the thin film heater, apparently due to varying current densities within the thin film material. Heat variation can be large near the perimeter edges of the thin film material or near heat sinks, where cooling effects are predominate and so-called edge thermal loss occurs. But some applications require that thin film heaters generate heat substantially uniformly so as to maintain a target set point temperature accurate to within about ±5° C. across the heater surface, including surface regions near the heater edges. Unfortunately achieving this goal is not readily accomplished in the prior art.

FIG. 1A depicts a conventional prior art thin film heater 10 in which the upper surface of a supporting substrate 10 (shown cross-hatched) is covered with a growth or deposition of thin film electrically conductive material 30.

Electrically conductive buss bar structures 40 are placed typically at opposite edges of the thin film material and will be connected by wires 50 to a source of voltage (Vs) 60. Buss bar structures in FIG. 1A (and in the other figures) can have a width of about 0.040" to about 0.375". Typically magnitudes of voltage Vs are about 3 V to about 240 V.

When electrical power Vs is connected, electrical current flows across thin film material 30, generating heat, much of which is transferred to the underlying substrate material 20. The efficiency of a thin film heater is a direct function of the substrate material type and mass. Efficiency is essentially the ability of a thin film heater to convert a given amount of energy to heat, to achieve a given rate of thermal increase, and to distribute thermal energy over the entire mass of the thin film heater. Conventional thin film heaters can achieve power densities exceeding 100 watts/square inch, and can attain temperatures exceeding 450° C. (840° F.). However, distribution of heat over the surface of the thin film heater can be uneven due to the effects of the geometry of the unit itself.

Substrate 10 preferably has a smooth upper surface and is made from material that includes, without limitation, glass, quartz, ceramic (alumina), aluminum nitride, silicon carbide, stainless steel, porcelainized steel. These or other materials can also be used, which materials can be in tubular, disk, block or sheet form. Such material types provide an electrically insulating surface upon which the layer of thin film material 20 will be applied. Further, such substrate materials can sustain the high temperatures desired for a heater, and are physically self-supporting. It is understood that where the material is a metal, e.g., stainless steel, the surfaces including the upper surface will be electrically insulating for example by virtue of a dielectric layer deposited on the substrate.

FIG. 1A depicts the various temperatures (in ° C.) attained at different locations on thin film material 20 for thin film heater 10, for which the desired and intended thermal set point was 150° C. It will be appreciated that there is substantial non-uniformity in the distribution of heating across the surface of heater 10. Heat variations can be especially troublesome at the peripheral edges and corners of thin film heater 10. In many heater structures, thin film material 30 substantially covers the entire upper surface of substrate 20. In other structures, one or more margins 70 may be required, which is to say, thin film material 30 will not completely cover all of the underlying surface of substrate 20 in the margin region. For example, thin film heaters that will be mounted or retained in a frame-like holder may require the presence of margins 70, and thus the exclusion of overlying thin film material in these regions. Understandably the presence of such margins can further complete the challenge of trying to generate heat uniformly across the heater surface. Such thermal edge losses can also occur in flat, round, tubular and other shaped thin film heater structures where there is a substantial surface area.

Heater 10 in FIG. 1A (as well as in FIG. 1B) has a thickness T of about 0.025" and is about 1"×1" in size, and for the thermal data shown in the figure has a thick ceramic tin oxide substrate 20. As noted, the desired thermal set point for the thin film heater 10 in FIG. 1A was 150° C. But as shown by the temperature values in FIG. 1A, the actual temperature attained at different regions of the heater deviate from this set point target by several ° C. The maximum temperature attained is 153° C., the lowest temperature is 147° C., and the thermal uniformity is ±3° C. Note for example that although the heater configuration is essentially symmetrical, e.g., square, temperature at the upper left corner of the heater missed the set point temperature by 3° C., while temperature at the lower left corner exceeded the set point temperature by 2° C. In many applications, such thermal non-uniformities may not be acceptable.

Heater 10 in FIG. 1B is identical the heater shown in FIG. 1A except that a set point temperature of 350° C. was desired. Unfortunately a substantial amount of thermal non-uniformity is apparent, with the maximum temperature being 351° C., the lowest temperature being 331° C., with a thermal uniformity of only ±10° C.

Heater 10 in FIG. 1C was formed on a polished quartz substrate 20, and was about 3.07"×4.82" in size, with a thickness T of about 0.125". Note that length of the thin film material 30 was intentionally made shorter than the length of the underlying substrate 20 such that margins 70 were formed on the short sides of the rectangular structure. A set point temperature of 114° C. was desired. Point 80 in FIG. 1C represents the center of the thin film heater element 30, at which location the 114° C. set point temperature should exist. But as shown, even at point 80 the set point temperature was missed (by 1° C.), and actual temperature across the surface of thermal element 30 varied from about 84° C. to 115° C., with a thermal uniformity of only ±15.5° C.

FIG. 1D depicts thermal variation in a larger sized heater 10 that measured 16"×24"×T=0.157", and had a glass ceramic material as substrate 20. A margin 70 of 1" surrounded the thin film material 30. The thermal set point temperature was 150° C., but actual temperature across the surface of thermal element 30 ranged from 101° C. to 155° C., a variation of ±27° C. Note that even at the center point 80, the target set point temperature was not attained. In FIG. 1D, the "° C." symbols were omitted to make the data shown more readable.

FIG. 1E is a top plan view of a somewhat narrow thin film heater 10 that measured 0.360"×10.625"×T=0.025". Substrate 20 was alumina with a thin film tin oxide coating. The numbers above the figures are measured temperature values in ° C. (where the "° C." symbol has been omitted due to space constraints). These temperatures were measured on the surface of the thin film heater element 30 at locations shown with a "dot", generally adjacent the temperature value. The dashed lines traversing the narrow width of thin film heater 10 denote different heating regions. In this embodiment the target set point temperature was 180° C., yet temperatures ranged from 99° C. to 193° C.

FIG. 1F is a side view of a tubular, rather than flat, thin film heater 10 formed about a quartz substrate 20, with a tin oxide resistive layer 30. Margins 70 were formed as shown. Two columns of temperature data (with the "° C." symbol omitted) denoted "TEMP A1" and "TEMP B1" are shown to the right of the heater. Column A1 data are temperature measured on the inside wall of the heater tube 20, and column B1 data are temperatures measured inside of a Teflon™ material tube inserted within the heater structure. (The temperature data were measured using a thin wire thermocouple.) The $V_s$ power source 60 and power leads 50 are omitted from FIG. 1F for clarity. Resistance Rbb, measured between buss bar structures 40, was about 81.2 Ohms. Various dimensions in inches are shown to the left and above the heater structure. As shown, the outer diameter of the heater was about 0.125", and the nominal target set point temperature was 95° C.

FIG. 1G is a side view of a somewhat similar tubular thin film heater 10, again formed with a quartz substrate 20 and a tin oxide resistive layer 30, and with margins 70. Thermal data for columns A1 and B1 represent temperatures (in ° C.) measured, respectively, on the inside wall of heater tube 20, and inside a Teflon™ material tube inserted within the heater structure. Resistance Rbb, measured between buss bar structures 40, was about 74.2 Ohms, and nominal target set point temperature was 95° C.

In reviewing the various prior art thin film heater embodiments shown in FIGS. 1A–1G, it is seen that in general the larger the surface area of a thin film heater, the more pronounced will be the thermal non-uniformity experienced by an object in contact with or in close proximity to the heated surface. In tube-shaped thin film heaters, FIGS. 1F and 1G, for example, or long narrow strip-shaped thin film heaters, pronounced loss of thermal energy is manifested at the ends of the heater structure.

Exemplary techniques for fabricating prior art thin film heaters are found in several U.S. patents. For example, U.S. Pat. No. 5,616,266 (1997) to Cooper discloses a cooking-type heater in which a thin film is formed on a ceramic-based layer atop a rigid metallic substrate, the goal being to attain 300° F. on an 18"×18" surface with a power density of about 6.17 watts/in$^2$, while consuming approximately 2 kW of electrical operating power. U.S. Pat. No. 6,376,816 (2002) to Cooper discloses a thin film heater useful to heat liquids. In Cooper '816, regions of thin film conducting material are molecularly bounded to outer surface regions of a tubular substrate to form the overall tubular heater. Neither of these exemplary two patents disclosed data regarding uniformity of heat distribution for the described thin film heaters.

Thus, there is a need for a method and structure by which thin film heaters can be fabricated so as to compensate for thermal edge loss. Fabrication of such thin film heaters preferably should use commercially available equipment, and the resultant heater should attain a target set point temperature with improved thermal uniformity over the heater surface.

The present invention provides such a thin film heater and methods for fabricating such thin film heaters.

SUMMARY OF THE INVENTION

Thin film heaters form a layer of thin film electrically conductive resistive material on the surface of a supporting substrate. Electric current is passed via buss bar structures through the thin film material to generate heat. Unfortunately the temperature attained at various areas on the thin film material can vary widely from an intended thermal set point, due in part to so-called edge loss effects at the perimeter of the heater.

The present invention compensates at least in part for edge loss effects in thin film heaters, including loss due to heat sinks, by removing preferably elongated regions of the thin film material adjacent substrate edges parallel to regions where the connective buss bar structures are formed. After these preferably elongated regions are defined, underlying substrate material becomes exposed. Alternately, during deposition of thin film material over the substrate, masking or other techniques can be used to prevent deposition over the desired elongated regions.

The removal of such regions of material from the otherwise continuous thin film material appears to control current densities within the resistive thin film material that enhances overall temperature uniformity. Arriving at a configuration or pattern of regions to be removed from the thin film material to yield acceptably good thermal uniformity can involve some trial and error. However once the configuration pattern has been determined, thin film heaters can then be mass produced using the pattern with consistently good thermal uniformity.

Other features and advantages of the invention will appear from the following description in which the preferred embodiments have been set forth in detail, in conjunction with the accompanying drawings.

BRIEF DESCRIPTION OF THE DRAWINGS

FIG. 2C-2 is a perspective view depicting varying thermal values attained for a thin film polished quartz substrate heater for which the intended thermal set point was 120° C. in for which perimeter temperatures were brought to above mid-temperature, according to present invention;

FIG. 2E-1 is a top plan view depicting varying thermal values attained for a thin film tin oxide ceramic substrate heater for which the intended thermal set point was 180° C., according to the present invention;

FIG. 2E-2 is a top plan view depicting varying thermal values attained for another embodiment of a thin film tin oxide ceramic substrate heater for which the intended thermal set point was 180° C., according to the present invention;

DETAILED DESCRIPTION OF THE PREFERRED EMBODIMENT

Figure 1A:
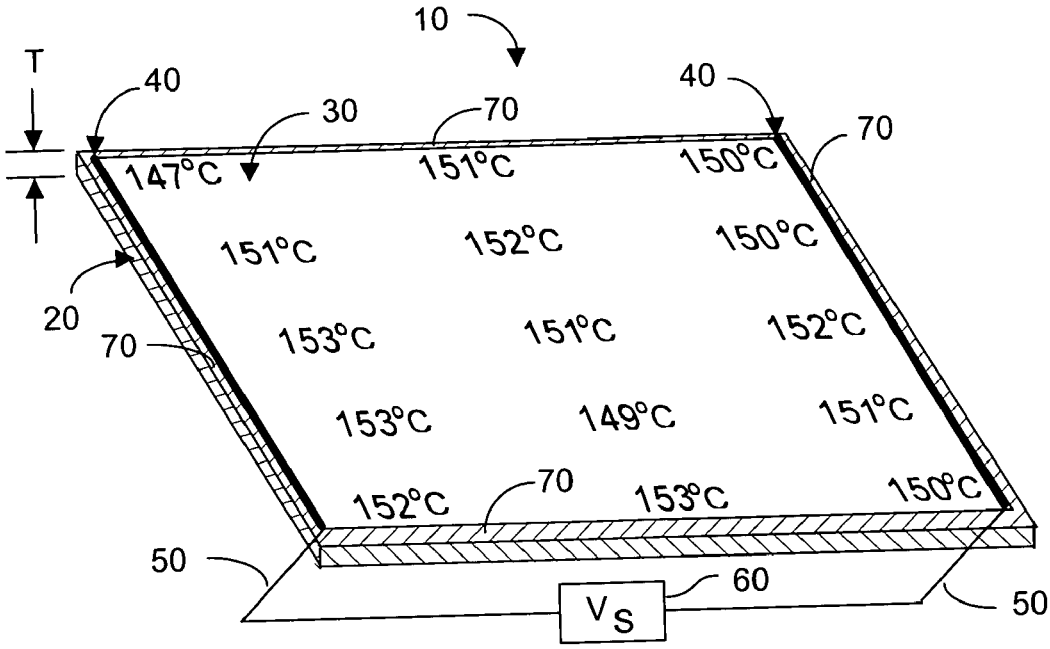
FIG. 1A (PRIOR ART)
FIG. 1A is a perspective view depicting varying thermal values attained for a thin film ceramic substrate, tin oxide heater for which the intended thermal set point was 150° C., according to the prior art.
Figure 1B:
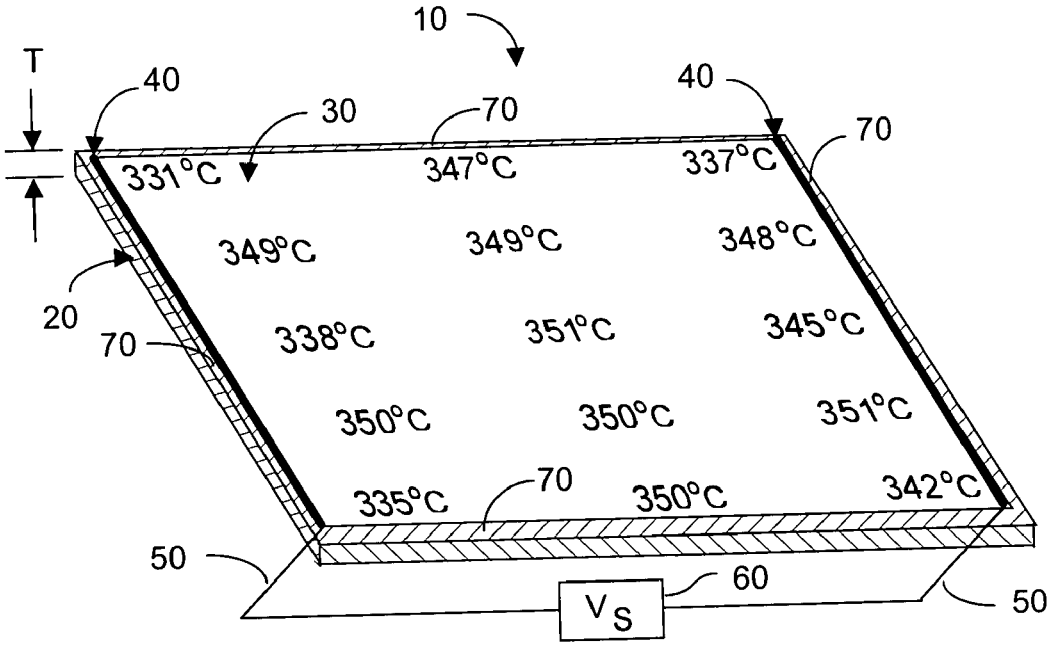
FIG. 1B (PRIOR ART)
FIG. 1B is a perspective view depicting varying thermal values attained for a thin film ceramic substrate, tin oxide heater for which the intended thermal set point was 350° C., according to the prior art.
Figure 1C:
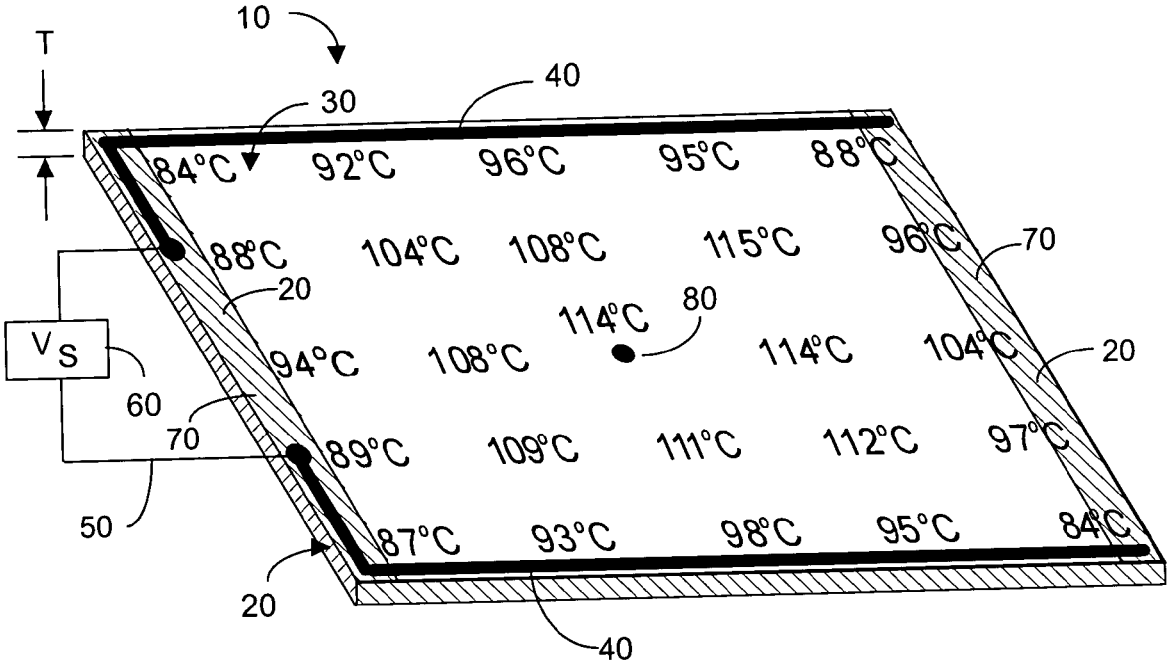
FIG. 1C (PRIOR ART)
FIG. 1C is a perspective view depicting varying thermal values attained for a thin film polished quartz substrate heater for which the intended thermal set point was 115° C., according to the prior art.
Figure 1D:
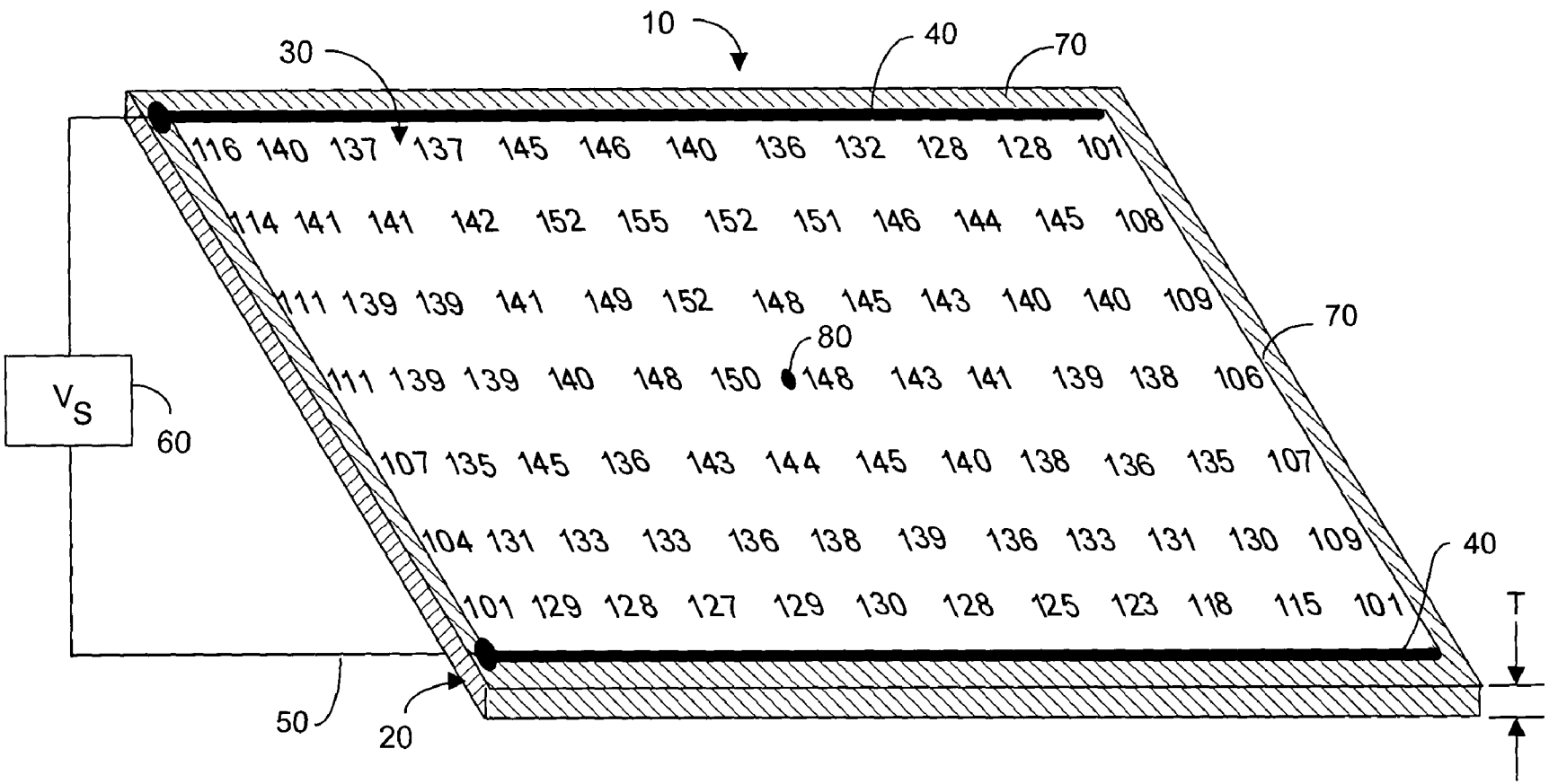
FIG. 1D (PRIOR ART)
FIG. 1D is a perspective view depicting varying thermal values attained for a thin film glass ceramic substrate heater for which the intended thermal set point was 150° C., according to the prior art.
Figure 1E:
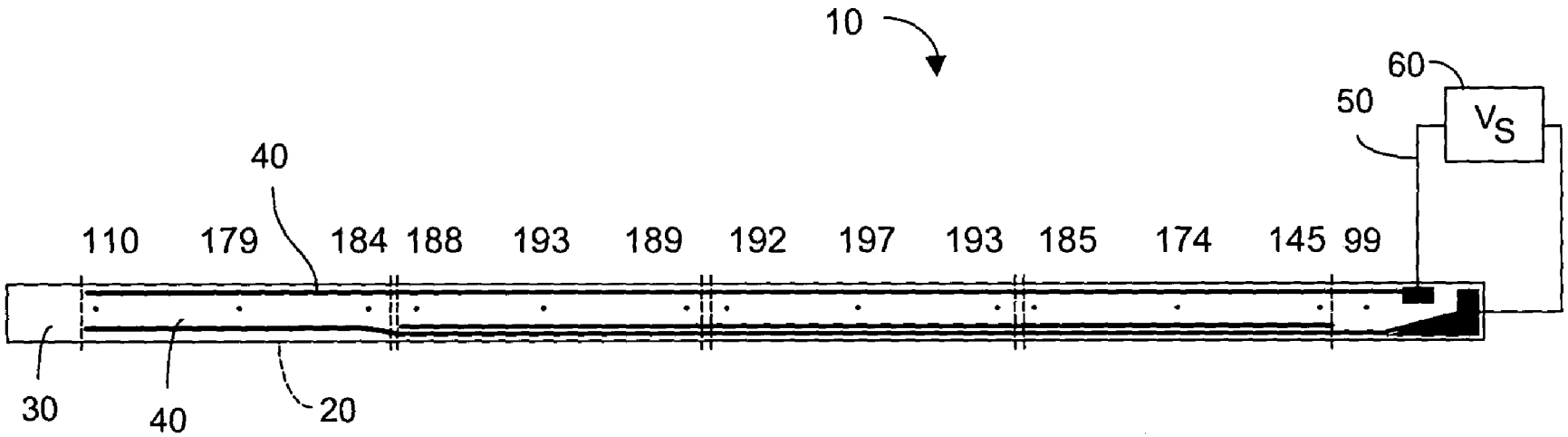
FIG. 1E (PRIOR ART)
FIG. 1E is a top plan view depicting varying thermal values attained for a thin film tin oxide, alumina substrate heater for which the intended thermal set point was 180° C., according to the prior art.
Figure 1F:
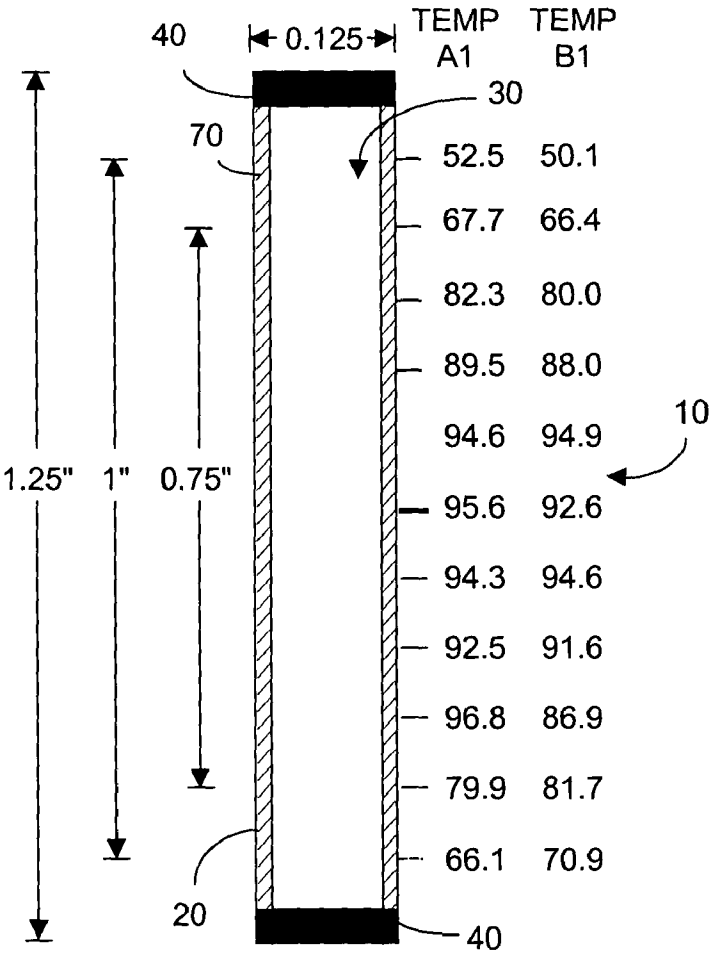
FIG. 1F (PRIOR ART)
FIG. 1F is a side view depicting varying thermal values attained for a thin film tin oxide, quartz substrate tubular heater, according to the prior art.
Figure 1G:
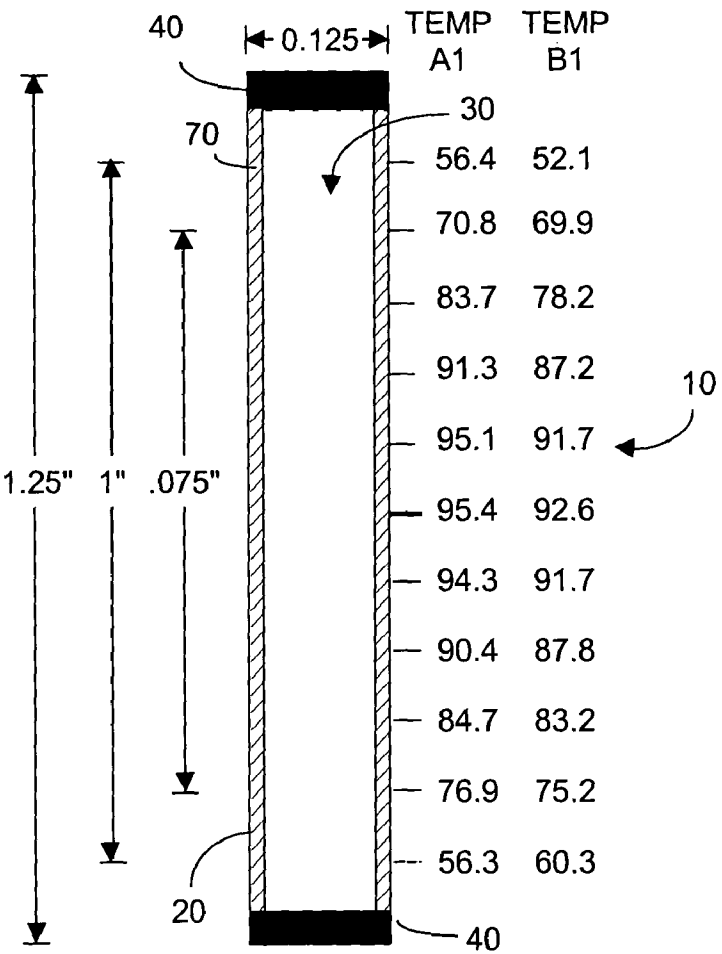
FIG. 1G (PRIOR ART)
FIG. 1G is a side view depicting varying thermal values attained for a thin film tin oxide, quartz substrate tubular heater, according to the prior art.
Figure 2A:
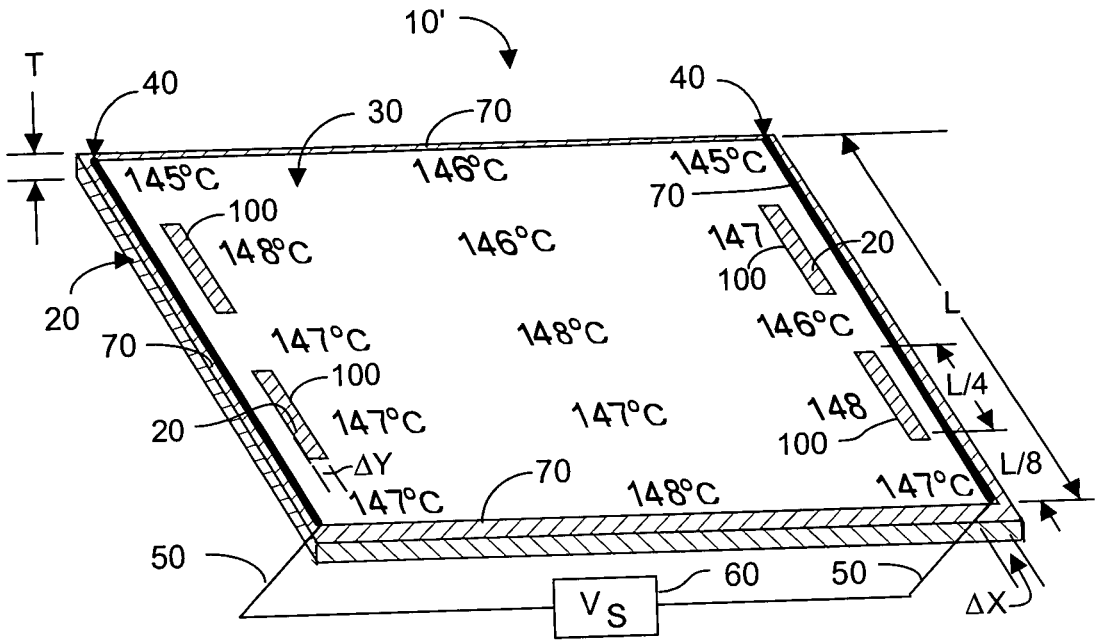
FIG. 2A is a perspective view depicting varying thermal values attained for a thin film ceramic substrate, tin oxide heater for which the intended thermal set point was 150° C., according to the present invention.

FIG. 2A depicts a thin film heater 10' according to the present invention. Thin film heater 10' is fabricated upon a surface of substrate 20 that may be identical in material composition to prior art thin film heaters such as have been described herein with respect to FIGS. 1A–1G. A layer of electrically conductive thin film material 30 is formed or deposited atop substrate 20, and the type of material used for thin film 30 may be identical to materials such as have been described herein. Substrate 20 will have an upper and a lower surface, and for ease of description it will be assumed that the thin film material will be formed or deposited on the upper substrate surface. Typically the substrate will have at least two edges that are spaced-apart and are substantially parallel to each other. In FIG. 2A, substrate 20 is rectangular in shape, and thus has two pairs of edges that are spaced-apart and are substantially parallel to each other.

However during deposition or formation of thin film layer 30, or subsequent to deposition or formation, preferably at least two regions (or openings) 100 of thin film material are removed (or are prevented from being deposited or formed at all) adjacent at least one and preferably two spaced-apart edges of the thin film material. These edges of the thin film material will themselves typically coincide with corresponding spaced-apart parallel edges of the underlying substrate, or will be parallel to such edges. In FIG. 2A, four regions 100 are formed, which is to say in these openings or regions one can see the underlying exposed substrate material 20. Exposed regions 20 preferably are defined adjacent the edges of the thin film material to which the spaced-apart buss bar structures 40 are formed.

Thin film heater 10' in FIG. 2A was sized 1"×1" with thickness T=0.025". Substrate 20 was the same type of ceramic material as was used to fabricate prior art heater 10 shown in FIG. 1A, and thin film material 30 included the same tin oxide material used in the prior art heater of FIG. 1A. Similarly to heater 10 in FIG. 1A, a target set point temperature of 150° C. was desired. The various numbers shown in FIG. 2A are the temperatures measured at various locations on the thin film material. Note that but—for the inclusion of exposed regions 100, heater 10' in FIG. 2A is identical to heater 10 in FIG. 1A. But providing exposed regions 100 adjacent the edges of the thin film material to which the buss bar structures 40 are attached substantially improves uniformity of the thermal distribution across the surface of heater 10'. Whereas for prior art heater 10 in FIG. 1A thermal variations ranged from 147° C. to 153° C., a uniformity of only ±3° C., heater 10' in FIG. 2A exhibits substantially improved thermal distribution: temperature variation is reduced to a range of 145° C. to 148° C., a uniformity of ±1.5° C.

By trial and error, applicants have learned that the number of openings 100 per edge preferably is at least two, where the longitudinal length of each opening is L/4, where the length of the adjacent edge is equal to L. Using this algorithmic approach, the distance between an adjacent pair of openings 100 preferably is L/4, and the distance between a short edge of an opening and the nearest parallel edge (e.g., an edge typically normal to the edge containing the buss bar structure 40) is preferably L/8. The offset distance between the edge of the thin film material that includes the nearest buss bar structure 40 and the nearest longitudinal edge of an opening is defined herein as ΔX. Width of an individual opening region 100 is defined herein as ΔY. Exemplary values of ΔY are about 0.010" to about 0.050", and exemplary values of ΔX are about 0.010" to about 1.0". In practice, a thin film heater is fabricated with openings formed per the above-described algorithm, and an infrared heat sensor is used to create a thermal model of the heater, although use of an infrared thermal camera would be preferred. A thermal map is generated, for example as shown in various of the embodiments herein. If further improvement in thermal distribution is desired, more than two open regions 100 may be defined along each edge with trial and error used to fine tune the number of positioning of such exposed regions. (See for example the embodiment of FIG. 2D in which six regions 100 were ultimately defined along each edge.)

The presence of exposed regions 100 defined in thin film material 20 appears to alter current distribution through the electrically conductive material. Thermal generation at a location in the electrically conductive material 20 is a function of current density. In practice, the presence of appropriately sized and positioned openings 100 can be used to cause an improvement in thermal distribution in a thin film heater 10'. Such improvement is self-evident from a comparison of widely varying temperatures attained at various location on prior art heater 10 in FIG. 1A, as contrasted with the improved range of temperatures attained at various locations on heater 10' as shown in FIG. 2A.

In the example of FIG. 2A, the side length L of the thin film material is 1". (In practice, the margin 70 in FIG. 2A and indeed in FIG. 1A was essentially zero, the margin being depicted to illustrate the fact that such margins may be formed.) For a hearer with L=1", the longitudinal length of each opening 100 is L/4 or 0.25". The distance separating adjacent openings 100 is also L/4 or 0.25". Thus out of the L=1" edge length of the thin film material 30, the two openings account for a total of 0.25"+0.25"=0.5", and the distance between the two openings accounts for an additional 0.25", or thus far a total of 0.75". The remaining 0.25" distance along the edge length of the thin film material is divided into equal parts (e.g., L/8=0.125"). Thus the offset from what is the top and bottom edges of the thin film material in FIG. 2A to the nearest portion of an opening 100 will be 0.125". To reiterate then, for the L=1" dimension used in FIG. 1A, there is a 0.125" portion of thin film material, a 0.25" region of exposed substrate (e.g., no thin film material is present), a 0.25" region of thin film material, another 0.25" region of exposed substrate, and a 0.125" portion of thin film material. This symmetry preferably is repeated for the other edge of heater 10'.

The side offset distance ΔX is made about 0.25" for thin film heaters with L>1", about 0.025" where L≈1", and can be made as small as about 0.010" for thin film heaters where L<1". Understandably some "fine tuning" trial and error may be employed as to precise size and location of openings 100, to further improve thermal distribution across the surface of thin film material 30. However once an acceptably good configuration of openings 100 is determined, space heater 10' can be mass produced with good production uniformity. The width ΔY of regions 100 typically will be about 0.010" to about 0.050".

The above described method for locating and sizing open regions 100 has been found to work in practice. In some applications, experimentation results in the use of more than two openings per edge, as defined above. In such applications, the two openings per edge represents a starting point for trial and error experimentation, which can result in more than two such openings per edge, including the use of openings having different dimensions from one another. Thus, more or fewer than two openings per edge can be used, including openings of different dimensions and shapes, e.g., perhaps square or circular rather than rectangular. However in many applications there is little reason to use more than two openings per edge given that as few as two openings per edge can provide satisfactory improvement in thermal distribution.

Those skilled in the art of formation of thin film heaters will appreciate that openings 100 may be defined in thin film material 30 in several ways. For example, during deposition of thin film material 30 atop the surface of substrate 20, masks can be provided at regions where openings 100 are to exist. The result is that thin film material 30 is deposited atop regions of substrate 20 except in regions that define openings 100. Conventional masking and deposition techniques may be used. In other applications it may be desired to simply deposit thin film material 30 atop the complete surface of substrate 20, and then remove, e.g., by etching among other techniques, thin film material from regions where openings 100 are to be defined. Applicants do not provide further detail or figures in that such deposition, masking, removal techniques are well known in the art and simply require no further description herein.

Figure 2B:
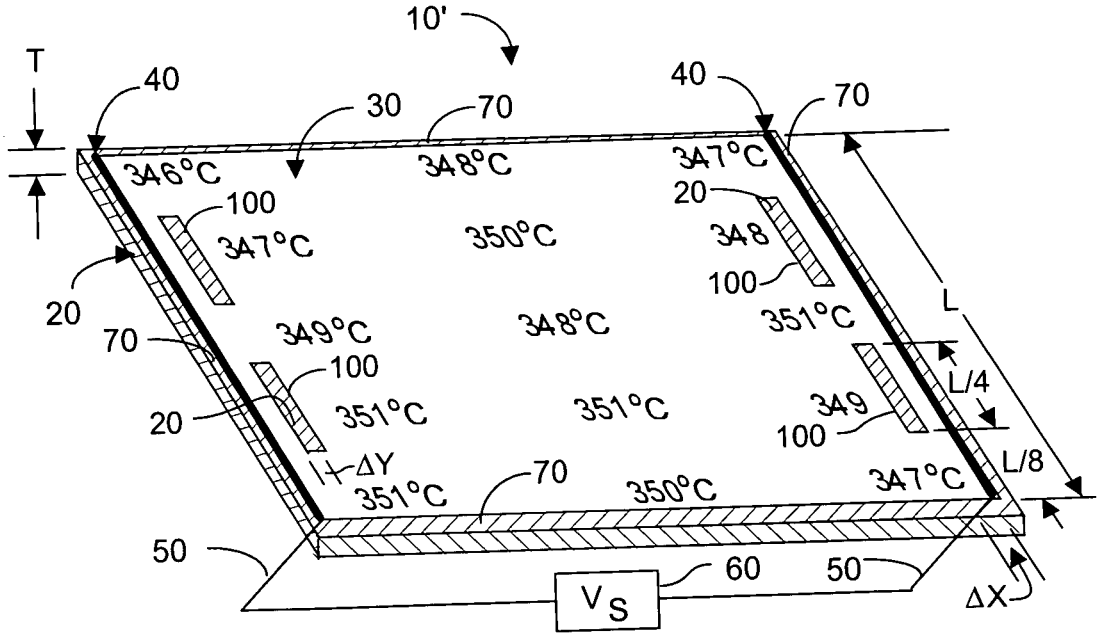
FIG. 2B is a perspective view depicting varying thermal values attained for a thin film ceramic substrate, tin oxide heater for which the intended thermal set point was 350° C., according to the present invention.

Turning now to thin film heater 10' shown in FIG. 2B, but for the inclusion of openings 100 defined in thin film material 30, heater 10' is identical to prior art heater 10, depicted in FIG. 1B. In FIG. 2B it is understood that openings 100 are sized and positioned and formed as described above with respect to FIG. 2A.

A comparison of temperature readings across the surface of prior art thin film heater 10 in FIG. 1B with thin film heater 10' in FIG. 2B demonstrates a substantial improvement in thermal distribution for heater 10'. Again the desired set point temperature was 350° C. In the prior art heater shown in FIG. 1B, temperatures ranged from 331° C. to 351° C., a uniformity variation of ±10° C. However by the simple inclusion of exposed regions 100 defined in thin film material 30, heater 10' shows a substantially improved thermal distribution: temperatures now range from only 346° C. to 351° C., a uniformity variation of only ±2.5° C.

Figures 1, 2C:
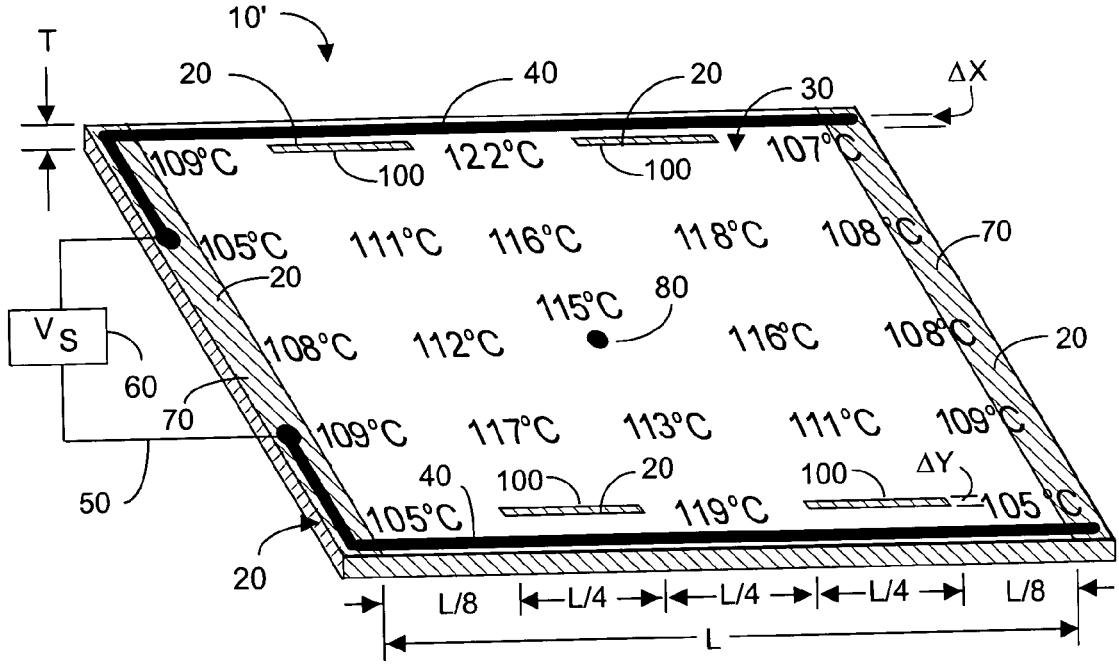
FIG. 2C-1 is a perspective view depicting varying thermal values attained for a thin film polished quartz substrate heater for which the intended thermal set point was 120° C., according to present invention.
Figures 2, 2C:
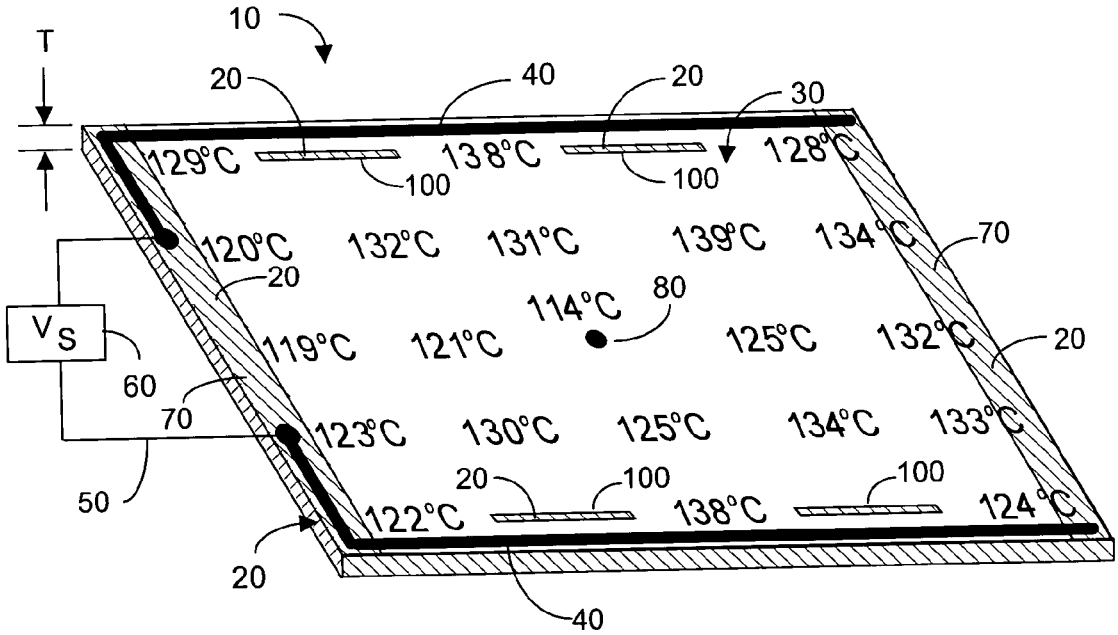

Consider now a comparison between prior art thin film heater 10 depicted in FIG. 1C and thin film heaters 10' depicted in FIGS. 2C-1 and 2C-2. In FIG. 1C, heater 10 had a set point temperature of 115° C. and exhibited temperatures that ranged from 84° C. to 115° C., a uniformity of ±15.5° C. Thin film heaters 10' in FIG. 2C-1 and 2C-2 were similar to heater 10 in FIG. 1C, but for the inclusion of exposed regions 100. Thus heaters 10' in FIGS. 2C-1 and 2C-2 were each 3.07"×4.82×T=0.125", and were formed with a polished quartz substrate. Set point temperature for heater 10' in FIG. 2C-1 was 120° C., and this heater showed a thermal variation of only 105° C. to 112° C., a uniformity variation of ±8.5° C. (contrasted with +15.5° C. for heater 10 in FIG. 1A). In FIG. 2C-2, heater 10' had a set point of 115° C. and exhibited a thermal variation ranging from 114° C. to 139° C. This data represent an overall improvement in thermal uniformity. However this data are presented to further demonstrate that openings 100 according to the present invention can be formed to tailor temperatures near the perimeter heater edges to be elevated higher than the actual set point temperature.

Figure 2D:
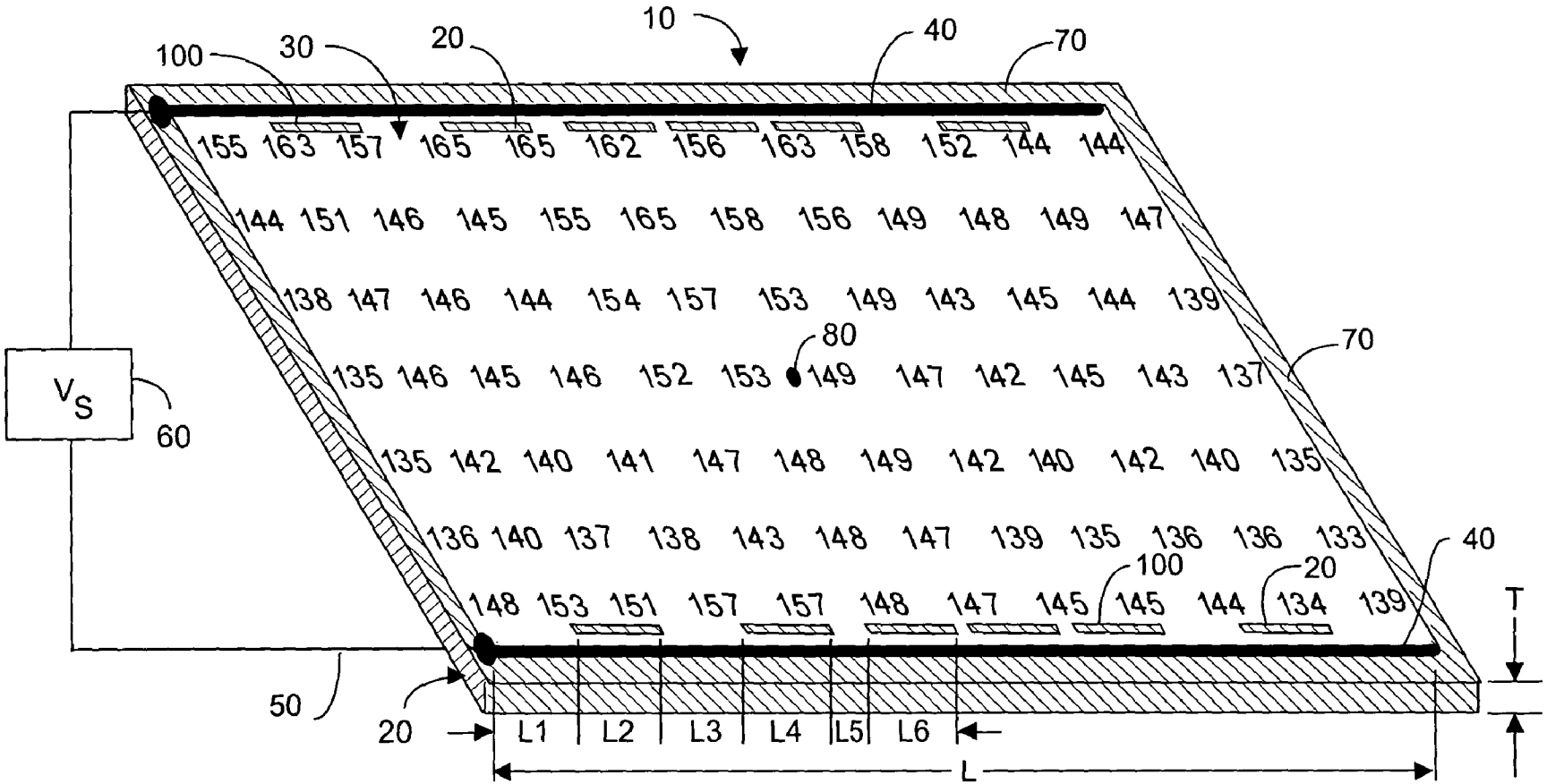
FIG. 2D is a perspective view depicting varying thermal values attained for a thin film glass ceramic substrate heater for which the intended thermal set point was 150° C., according to the present invention.

Compare now large plate thin film heater 10 in FIG. 1D with thin film heater 10' in FIG. 2D. Each heater measures about 16"×24"×T=0.157" and is formed on a glass ceramic substrate with a target set point temperature (ideally occurring at central spot 80) of 150° C. Heater 10' in FIG. 2D also had a 1" margin 70 at the outer perimeter of thin film material 20.

Heater 10' in FIG. 2D includes a number of exposed regions 100 defined in thin film material 30, here six such regions adjacent the upper and lower edges of the thin film material, parallel to the sides of heater 10' that include buss bar structures 40. In this embodiment, which differs in the number of exposed regions 100 from heaters 10' in FIGS. 2A–2C-2, note that substantial control over the temperature attained at the short edges of heater 10' results, e.g., the edges normal to the edges adjacent to the exposed regions. In some applications it may be desired to create a controlled thermal gradient across the surface of heater 10', as shown in FIG. 2D. In FIG. 2D, exemplary dimensions are L1=1.5", L2=2", L3=2", L4=2", L5=1", L6=1". Near the bottom edge, the right-most three open regions 100 have the same dimensions as above noted for the left-most three open regions, and on the upper edge, the six open regions 100 have the same dimensions as the open regions formed near the bottom edge.

Comparing the thermal data shown in FIG. 2D with that shown in FIG. 1D it is seen that uniformity is improved: ±27° C. in FIG. 1D and ±16° C. in FIG. 2D. Note too that substantial perimeter cooling appears in the configuration of FIG. 1D, especially in the corner regions. By contrast, peripheral regions in heater 10 in FIG. 2D are in several locations actually higher than the 150° C. set point temperature.

In arriving at the configuration shown in FIG. 2D, applicants first applied the algorithm referred to earlier herein as a starting point. However in practice, the configuration shown in FIG. 2D with six, rather than two, regions 100 defined parallel to each heater edge having the buss bar structure provided superior thermal uniformity. In some applications (e.g., that shown in FIG. 2D), use of the algorithm referred to herein represents a good starting point, with "tweaking" or fine tuning in the form of adding additional exposed regions 100 used to arrive at the final design, based upon some trial and error experimentation in the number and location of regions 100.

Figures 1, 2E:
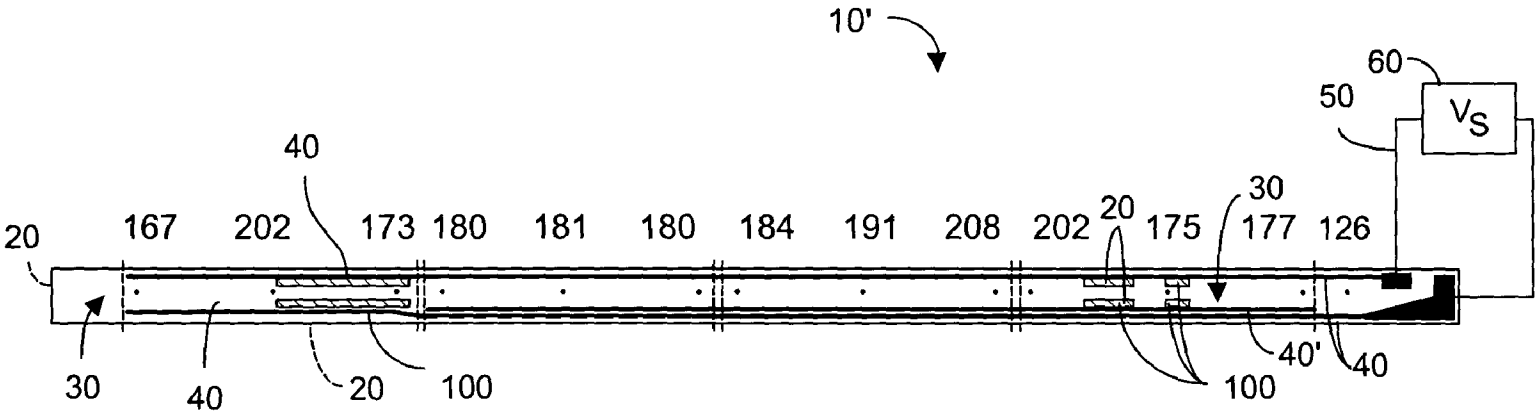
Figures 2, 2E:
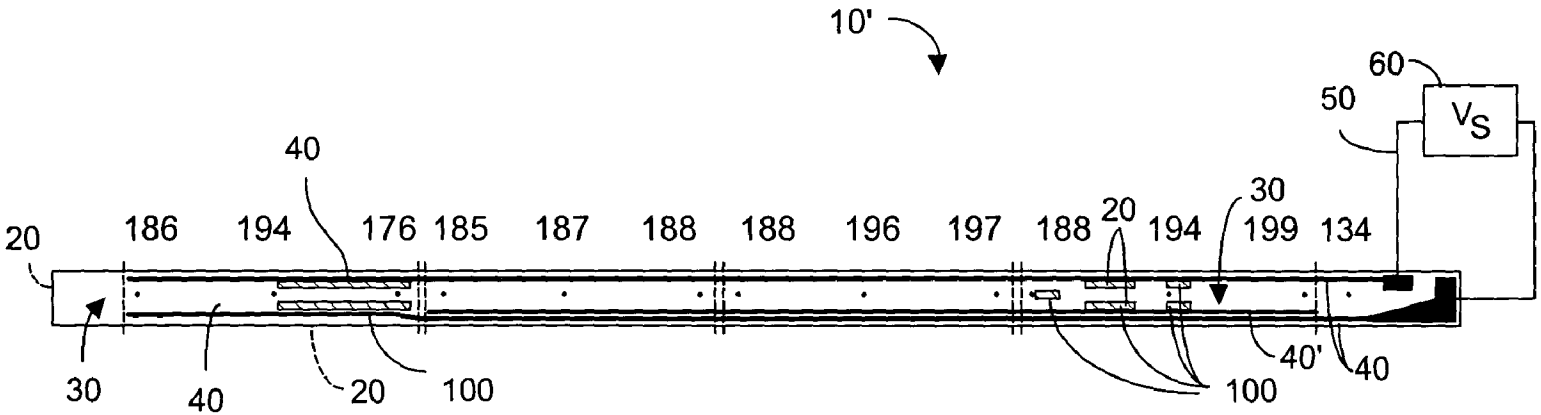

Heaters 10' in FIG. 2E-1 and FIG. 2E-2 are somewhat similar to prior art heater 10 shown in FIG. 1E but for the inclusion of open regions 100 defined or formed adjacent the edges of thin film material 30 parallel to buss bar structures 40. A total of six regions 100 are present in heater 10' in FIG. 2E-1, and a seventh region 100 is added in the embodiment of FIG. 2E-2. Heaters 10' measured about 0.36"×10.625"×T=–0.025", and were formed on an tin oxide ceramic substrate 20. The set point temperature for heaters 10' (as well as heater 10 in FIG. 1E) was 180° C. In FIGS. 2E-1 and 2E-2 temperature values in ° C. are shown above heaters 10', which temperatures were measured on the heater surface where "dots" generally beneath the temperature values are shown.

In prior art heater 10 in FIG. 1E, the temperature near the center of the heater, looking left-to-right in the figure, was close to about 192° C., a higher temperature than the target set point of 180° C. Note too in FIG. 1E that substantial cooling occurred in temperature distribution. Near the left end of heater 10, the temperature was down to 110° C., and near the right end the temperature cooled to 99° C. By contrast, heater 10' in FIG. 2E-1 attained a temperature of about 184° C. near the midpoint (a value close to the target 180° C. set point) and exhibited decreased cooling across the heater surface. For example at the left end of heater 10' in FIG. 2E-1, temperature was 167° C. (compared to 110° C. for heater 10 in FIG. 1E), and at the right end of heater 10', temperature was 126° C. (compared to only 99° C. for heater 10). This substantial improvement in uniformity of thermal distribution across heater 10' is achieved by the simple expedient of defining or forming openings 100 in thin film material 30, to expose underlying regions of substrate 20.

Heater 10' in FIG. 2E-2 includes a seventh opening and provides substantially improved performance in thermal uniformity, even over the improved embodiment of FIG. 2E-1. Near the center region, temperature was about 196° C., higher than the 180° C. target set point. However note the improvement in uniformity of temperature across the surface of heater 10'. At the left end of the structure, the temperature was 186° C. (compared with 110° C. for heater 10 in FIG. 1E), and at the right end of the structure the temperature was 134° C. (compared with 99° C. for heater 10 in FIG. 1E). Again the simple expedient of defining or forming open regions 100, seven such regions being present in FIG. 2E-2, produces improved thermal uniformity characteristics for heater 10'.

In FIGS. 2E-1 and 2E-2, the left-to-right length of the longest open regions 100 (near the left end of heater 10') was about 0.8" with a width of about 0.015". Toward the right end of heater 10' the smaller open region 100 had a length of about 0.2", while the larger open region had a length of about 0.3". In FIG. 2E2, the seventh open region 100 (which appears to the left of the four regions 100 near the right end of heater 10') had a length of about 0.2". The width of the various openings 100 was about 0.015". Again the configurations shown in FIGS. 2E-1 and 2E-2 were arrived at after first using the algorithm referred to earlier herein, and then using trial and error with respect to the number and size and location of exposed regions 100.

Figure 2G:
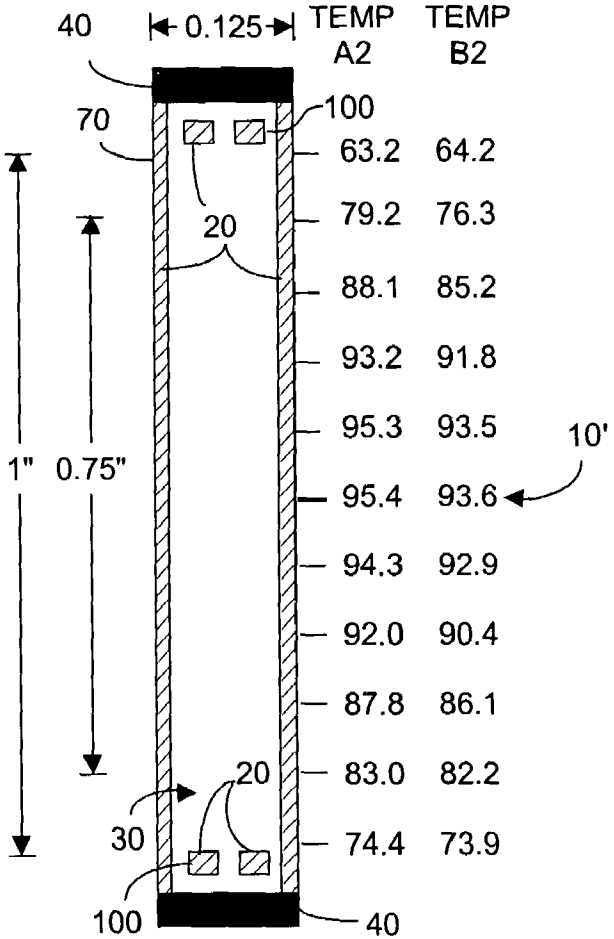
FIG. 2G is a side view depicting varying thermal values attained for a thin film tin oxide, quartz substrate tubular heater, according to the present invention.
Figure 2F:
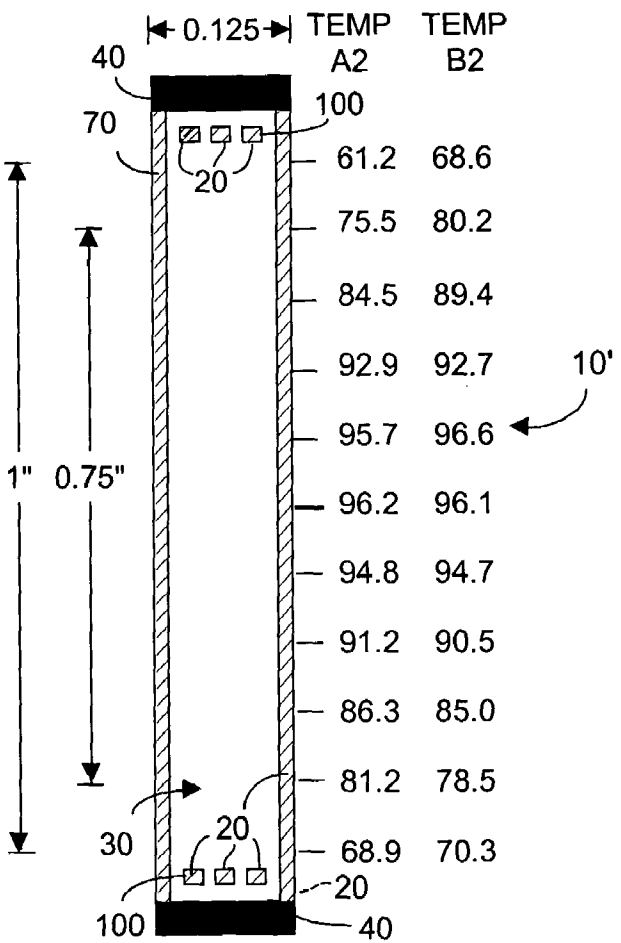
FIG. 2F is a side view depicting varying thermal values attained for a thin film tin oxide, quartz substrate tubular heater, according to the present invention.

FIGS. 2F and 2G depict tubular thin film heaters 10' that are similar to prior art heaters 10 in FIGS. 1F and 1G but for the presence of exposed regions 100 defined in thin film material 30 adjacent the edge of the thin film material upon which buss bar structures 40 are formed. In the configuration of FIG. 2F three such exposed regions are defined or formed at each end of heater 10', and in the configuration of FIG. 1G two such exposed regions are defined or formed. Resistance $R_{BB}$ measured between buss bar structures 40 was about 85 Ohms for heater 10' in FIG. 2F, and was about 94.9 Ohms for heater 10' in FIG. 2G.

In FIG. 2F, the six exposed or removed regions 100 were each sized about 0.030"×0.030" and were equally spaced about each end of the tubular heater structure as shown. In FIG. 2G, the four exposed or removed regions 100 were each sized about 0.075" and were equally spaced about each end of the tubular heater structure as shown. Again, temperature values shown in FIGS. 2F and 2G under column "TEMP A2" represent temperature values (in ° C.) measured on the inside wall of the heater tube, and values under column "TEMP B2" represent temperature values measured within a Teflon™ material tube inserted within the heater structure. As was the case for data shown in FIGS. 1F and 1G, temperature data were measured using a thin wire thermocouple.

Comparing temperature data for prior art heaters 10 in FIGS. 1F and 1G, with data for heaters 10' in FIGS. 2F and 2G, it is seen that the simple inclusion of exposed regions 100 results in elevated temperatures near the heater ends, relatively to the heater center. In FIG. 1F, for example, temperature at the heater center was 95.4° C. (see TEMP A1 data) but cooled to about 56.3° C. or 56.4° C. at the heater ends. By contrast, heater 10' in FIG. 2F exhibited a 96.2° C. temperature at the heater center and 61.2° C. and 68.9° C. temperature at the heater ends. Somewhat similarly, heater 10 in FIG. 1G exhibited a temperature of about 95.6° C. at the heater center and a decreased temperature of 66.1° C. and 52.5° C. at the heater ends. By contrast, heater 10' in FIG. 2G exhibited a temperature of about 95.4° C. at the heater center and a temperature of 74.4° C. and 63.2° C. at the heater ends. Essentially the present invention elevates temperature at the ends (e.g., tops and bottoms) of heaters 10' in FIGS. 2F and 2G by the simple expedient of defining openings 100 in thin film material 30 to expose the underlying substrate 20.

In summary, thermal uniformity across the surface of the thin film material in a thin film heater can be altered and improved by defining or forming open regions in the thin film material. Preferably such regions are provided parallel to the spaced-apart edges of the thin film material that are parallel to the edges along which are formed or placed buss bar structures. Preferably at least two exposed regions are formed or defined adjacent each edge and preferably each region is rectangular in shape when viewed from above. Exposed regions having other shapes could be used, however.

Modifications and variations may be made to the disclosed embodiments without departing from the subject and spirit of the invention as defined by the following claims.

What is claimed is:

1. A method of producing a tin oxide thin film heater, comprising the following steps:

(a) providing a substrate having an upper and lower surface, and at least two spaced-apart edges that are parallel to each other;

(b) forming on at least a portion of said upper surface of said substrate a thin film layer of tin oxide material having at least two spaced-apart edges that are parallel to said two spaced-apart edges of said substrate;

(c) adjacent said two spaced-apart edges of said thin film material, removing tin oxide material to define at least two regions that are parallel to said two spaced-apart edges of the thin film layer in which an underlying region of said upper surface of said substrate is exposed;

wherein when electrical power is coupled between said two spaced-apart edges of said thin film layer, heat distribution across said thin film layer is more uniform than if said regions defined at step (c) were absent.

2. The method of claim 1, wherein step (a) includes providing a non-conductive substrate.

3. The method of claim 1, wherein step (a) includes providing an electrically conductive substrate whose upper surface is treated with a dielectric coating.

4. The method of claim 1, wherein step (a) includes selecting a substrate material from a group consisting of glass, quartz, glass ceramic, alumina, and metal.

5. The method of claim 1, wherein said substrate is planar.

6. A method of producing a thin film heater, comprising the following steps:

(a) providing a substrate having an upper and lower surface, and at least two spaced-apart edges that are parallel to each other;

(b) forming on at least a portion of said upper surface of said substrate a layer of electrically conductive thin film material having at least two spaced-apart edges that are parallel to said two spaced-apart edges of said substrate;

(c) adjacent said two spaced-apart edges of said thin film material, removing thin film material to define at least two regions that are parallel to said two spaced-apart edges of the thin film material so as to expose an underlying region of said upper surface of said substrate;

wherein when electrical power is coupled between said two spaced-apart edges of said thin film material heat distribution across said thin film material is more uniform than if said regions defined at step (c) were absent;

wherein said substrate is tubular.

7. The method of claim 1, wherein step (c) includes etching away areas of said thin film material to define said regions in said thin film material.

8. A method of producing a thin film heater, comprising the following steps:

(a) providing a substrate having an upper and lower surface, and at least two spaced-apart edges that are parallel to each other;

(b) providing a deposition pattern on said upper surface of said substrate, said deposition pattern covering at least two regions of said substrate that are parallel to said two spaced-apart edges of said substrate;

(c) depositing a layer of electrically conductive thin film material over said deposition pattern so as to cover said upper surface of said substrate but for said regions covered by said deposition pattern to form a thin film region having two spaced-apart edges that are parallel to said spaced-apart edges of said substrate, said thin film region being continuous and uninterrupted except for said regions covered by said deposition pattern;

(d) removing said deposition pattern provided at step (b) so as to expose an underlying region of said upper surface of said substrate corresponding to each of said regions covered by said deposition pattern such that said layer of electrically conductive thin film material defines at least two exposed substrate regions completely contained within said thin film region that are not covered by said layer of conductive thin film material;

wherein when electrical power is coupled between said two spaced-apart edges of said thin film region, heat distribution across said thin film region is more uniform than if said exposed substrate regions were unexposed.

9. The method of claim 8, wherein step (a) includes providing a non-conductive substrate.

10. The method of claim 8, wherein step (a) includes providing an electrically conductive substrate whose upper surface is treated with a dielectric coating.

11. The method of claim 8, wherein step (a) includes selecting a substrate material from a group consisting of glass, quartz, glass ceramic, alumina, and metal.

12. The method of claim 8, wherein said substrate is planar.

13. A method of producing a thin film heater, comprising the following steps:

(a) providing a substrate having an upper and lower surface, and at least two spaced-apart edges that are parallel to each other;

(b) providing a deposition pattern on said upper surface of said substrate, said deposition pattern covering at least two regions of said substrate that are parallel to said two spaced-apart edges of said substrate;

(c) depositing a layer of electrically conductive thin film material over said deposition pattern so as to cover said upper surface of said substrate but for said regions covered by said deposition pattern;

(d) removing said deposition pattern provided at step (b) such that said layer of electrically conductive thin film material defines said regions so as to expose an underlying region of said upper surface of said substrate;

wherein when electrical power is coupled between two spaced-apart edges of said thin film material that are parallel to said two spaced-apart edges of said substrate, heat distribution across said thin film material is more uniform than if said regions exposed at step (d) were unexposed;

wherein said substrate is tubular.

14. A method of producing a thin film heater, comprising the following steps:

(a) providing a substrate having an upper and lower surface, at least two spaced-apart edges that are parallel to each other, and two spaced-apart buss structures on said upper surface;

(b) forming on at least a portion of said upper surface of said substrate a layer of electrically conductive thin film material having at least two spaced-apart edges that are parallel to said two spaced-apart edges of said substrate and electrically connected to said buss structures, wherein said buss structures are provided only at a perimeter of said layer of electrically conductive film material such that said portion of said upper surface on which said layer is formed is substantially free from buss structures;

(c) adjacent said two spaced-apart edges of said thin film material, removing thin film material to define at least two regions that are parallel to said two spaced-apart edges in which an underlying region of said upper surface of said substrate is exposed;

wherein when electrical power is coupled between said two spaced-apart edges of said thin film material heat distribution across said thin film material is more uniform than if said regions defined at step (c) were absent.

15. The method of claim 14, wherein step (a) includes providing a non-conductive substrate.

16. The method of claim 14, wherein step (a) includes providing an electrically conductive substrate whose upper surface is treated with a dielectric coating.

17. The method of claim 14, wherein step (a) includes selecting a substrate material from a group consisting of glass, quartz, glass ceramic, alumina, and metal.

18. The method of claim 14, wherein said substrate is planar.

19. The method of claim 14 wherein said substrate is tubular.

20. The method of claim 14, wherein step (c) includes etching away areas of said thin film material to define said regions in said thin film material.

* * * * *